US011788764B2

(12) United States Patent
Ma et al.

(10) Patent No.: US 11,788,764 B2
(45) Date of Patent: Oct. 17, 2023

(54) AIR CONDITIONER

(71) Applicant: GD MIDEA AIR-CONDITIONING EQUIPMENT CO., LTD., Guangdong (CN)

(72) Inventors: Lie Ma, Guangdong (CN); Jielin Peng, Guangdong (CN); Yuan Chen, Guangdong (CN); Qian Yun, Guangdong (CN); Yuanle Zhou, Guangdong (CN); Kunyao Wang, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 181 days.

(21) Appl. No.: 16/812,873

(22) Filed: Mar. 9, 2020

(65) Prior Publication Data

US 2020/0217555 A1 Jul. 9, 2020

Related U.S. Application Data

(63) Continuation of application No. PCT/CN2018/084924, filed on Apr. 27, 2018.

(30) Foreign Application Priority Data

Sep. 12, 2017 (CN) ..... 201710819422.5
Sep. 12, 2017 (CN) ..... 201721169982.2

(51) Int. Cl.
*F24F 13/20* (2006.01)
*F24F 13/08* (2006.01)
(Continued)

(52) U.S. Cl.
CPC ..... *F24F 13/10* (2013.01); *F24F 13/08* (2013.01); *F24F 13/20* (2013.01); *F24F 13/32* (2013.01); *F24F 1/0007* (2013.01)

(58) Field of Classification Search
CPC .. F24F 13/10; F24F 13/20; F24F 13/32; F24F 13/08; F24F 1/0007
(Continued)

(56) References Cited

U.S. PATENT DOCUMENTS 4,729,293 A * 3/1988 Tsunoda ..... F24F 13/1426 454/313
6,887,149 B2 * 5/2005 Palmer ..... F24F 6/043 62/262
(Continued)

FOREIGN PATENT DOCUMENTS

CN 2446431 Y 9/2001
CN 2446431 Y * 9/2001
(Continued)

OTHER PUBLICATIONS

JP-2002130718-A WIPO translation (Year: 2022).*
(Continued)

*Primary Examiner* — Michael G Hoang
*Assistant Examiner* — Andrew W Cheung
(74) *Attorney, Agent, or Firm* — Scully, Scott, Murphy & Presser, P.C.

(57) ABSTRACT

An air conditioner is provided. A main body of the air conditioner is provided with an air outlet having a front opening. The main body is also provided with a side air guide member for guiding airflow to at least one of a left side and a right side of the air conditioner.

12 Claims, 4 Drawing Sheets

(51) Int. Cl.
*F24F 1/0007* (2019.01)
*F24F 13/10* (2006.01)
*F24F 13/32* (2006.01)

(58) Field of Classification Search
USPC ..... 454/313
See application file for complete search history.

(56) References Cited

U.S. PATENT DOCUMENTS

| | | | | |
|---|---|---|---|---|
| 7,497,090 | B2 * | 3/2009 | Lee | F24F 1/0073 416/175 |
| 7,758,409 | B2 * | 7/2010 | Yamashita | F24F 13/20 454/313 |
| 2002/0144513 | A1 * | 10/2002 | Gunji | F24F 1/0063 62/298 |
| 2009/0158765 | A1 * | 6/2009 | Ooishi | F24F 13/20 62/263 |
| 2010/0287973 | A1 * | 11/2010 | Son | F24F 1/0076 62/407 |

FOREIGN PATENT DOCUMENTS

| | | | | | |
|---|---|---|---|---|---|
| CN | 1580661 | A | | 2/2005 | |
| CN | 1580661 | A | * | 2/2005 | |
| CN | 201106913 | Y | * | 8/2008 | |
| CN | 201106913 | Y | | 8/2008 | |
| CN | 103335388 | A | | 10/2013 | |
| CN | 104422094 | A | | 3/2015 | |
| CN | 104697051 | A | | 6/2015 | |
| CN | 204830295 | U | * | 12/2015 | F24F 5/00 |
| CN | 204830295 | U | | 12/2015 | |
| CN | 204987237 | U | | 1/2016 | |
| CN | 105485765 | A | | 4/2016 | |
| CN | 105928074 | A | | 9/2016 | |
| CN | 205579916 | U | | 9/2016 | |
| CN | 106196537 | A | | 12/2016 | |
| CN | 106403030 | A | | 2/2017 | |
| CN | 206018823 | U | | 3/2017 | |
| CN | 106594881 | A | | 4/2017 | |
| CN | 106895485 | A | | 6/2017 | |
| CN | 206247479 | U | | 6/2017 | |
| CN | 106949557 | A | | 7/2017 | |
| CN | 107062398 | A | | 8/2017 | |
| CN | 107084427 | A | | 8/2017 | |
| CN | 107676868 | A | | 2/2018 | |
| CN | 207555744 | U | | 6/2018 | |
| EP | 1553358 | A1 | | 7/2005 | |
| EP | 3 382 287 | A1 | | 10/2018 | |
| HR | 20030083059 | A | * | 10/2003 | F24F 13/20 |
| JP | S60-171030 | A | | 9/1985 | |
| JP | S61-272537 | A | | 12/1986 | |
| JP | H05-141680 | A | | 6/1993 | |
| JP | H09-196456 | A | | 7/1997 | |
| JP | H10-122589 | A | | 5/1998 | |
| JP | H10-148352 | A | | 6/1998 | |
| JP | H11-257727 | A | | 9/1999 | |
| JP | H11-311446 | A | | 11/1999 | |
| JP | 2000-146276 | A | | 5/2000 | |
| JP | 2000-220878 | A | | 8/2000 | |
| JP | 2002-130718 | A | | 5/2002 | |
| JP | 2002130718 | A | * | 5/2002 | |
| JP | 2002213808 | A | | 7/2002 | |
| JP | 2003-194362 | A | | 7/2003 | |
| JP | 2003-240313 | A | | 8/2003 | |
| JP | 2007-205711 | A | | 8/2007 | |
| JP | 2008-190779 | A | | 8/2008 | |
| JP | 2008-275192 | A | | 11/2008 | |
| JP | 4548979 | B2 | | 9/2010 | |
| JP | 2011-179739 | A | | 9/2011 | |
| KR | 20030083059 | A | * | 10/2003 | |
| KR | 20030083059 | A | | 10/2003 | |
| KR | 20030087315 | A | | 11/2003 | |
| KR | 100432222 | B1 | * | 5/2004 | |
| KR | 10-2005-0117666 | A | | 12/2005 | |
| KR | 10-0748172 | B1 | | 8/2007 | |
| KR | 101287527 | B1 | | 7/2013 | |
| KR | 10-2017-0051095 | A | | 5/2017 | |
| SU | 1629703 | A1 | | 2/1991 | |
| WO | 2016/197747 | A1 | | 12/2016 | |
| WO | WO 2016/197747 | A1 | | 12/2016 | |
| WO | 2017/024637 | A1 | | 2/2017 | |
| WO | WO 2017/024637 | A1 | | 2/2017 | |

OTHER PUBLICATIONS

KR-20030083059-A KIPO translation (Year: 2022).*
Search Report dated Jul. 23, 2020 received in European Patent Application No. EP 18855423.2.
Notification of Reason for Refusal dated Feb. 19, 2021 received in Korean Patent Application No. KR 10-2020-7004518 together with an English language translation.
Notification of Reason for Refusal dated Feb. 19, 2021 received in Korean Patent Application No. KR 10-2020-7004815 together with an English language translation.
Examination Report No. 1 dated Nov. 2, 2020 received in Australian Patent Application No. AU 2018333383.
First Office Action dated Apr. 28, 2019 received in Chinese Patent Application No. 201710819422.5 together with an English language translation.
Second Office Action dated Dec. 31, 2019 received in Chinese Patent Application No. 201710819422.5 together with an English language translation.
Notice of Reasons for Refusal dated Sep. 1, 2020 received in Japanese Patent Application No. JP 2019-542080 together with an English language translation.
Examination Report No. 1 dated Dec. 3, 2020 received in Australian Patent Application No. AU 2018331011.
Notice of Reasons for Refusal dated Mar. 30, 2021 received in Japanese Patent Application No. JP 2019-542080 together with an English language translation.
Notice of Reasons for Refusal dated Apr. 6, 2021 received in Japanese Patent Application No. JP 2020-511479 together with an English language translation.
Examination Report No. 2 dated Mar. 18, 2021 received in Australian Patent Application No. AU 2018333383.
Extended European Search Report dated May 4, 2020 received in European Patent Application No. EP 18856323.3.
Notification of Reason for Refusal dated Aug. 27, 2021 received in Korean Patent Application No. KR 10-2020-7004815 together with an English language translation.
Notice of Reasons for Refusal dated Sep. 7, 2021 received in Japanese Patent Application No. JP 2020-511479 together with an English language translation.
International Search Report dated Jul. 10, 2018 issued in PCT/CN2018/084924.
First Office Action dated Jan. 24, 2022 received in Chinese Patent Application No. CN 202110374172.5 together with an English language translation.
First Office Action dated Jan. 24, 2022 received in Chinese Patent Application No. CN 202110374328.X together with an English language translation.
Office Action dated Mar. 11, 2022 received in European Patent Application No. EP 18856323.3.
Office Action dated Mar. 23, 2022 received in European Patent Application No. EP 18855423.2.
Request for the Submission of an Opinion dated May 24, 2022 received in Korean Patent Application No. KR 10-2020-7004815.

* cited by examiner

AIR CONDITIONER

FIELD

The present disclosure relates to the field of air conditioning technology, and more particularly, to an air conditioner.

BACKGROUND

With more occurrence of extreme weather, air conditioners have reached millions of households for providing an amicable environment for people's lives and work. However, during the use of air conditioners, the air conditioners directly blow air to people, which may cause discomfort, and especially when the human body temperature and the ambient temperature are relatively low, the cold air blown to people causes discomfort, which becomes more salient for senior people.

SUMMARY

According to an aspect of the present disclosure, an air conditioner is provided, which has a satisfactory air guiding effect and is more comfortable to use.

An air conditioner according to an embodiment of the present disclosure includes a main body. The main body is provided with an air outlet having a front opening, and the main body is provided with a side air guide member for guiding air to at least one of a left side and a right side of the air conditioner.

The air conditioner according to the embodiment of the present disclosure has a good air guiding effect and is more comfortable to use.

In addition, the air conditioner according to the aforementioned embodiment of the present disclosure can also have the following additional technical features.

In an embodiment of the present disclosure, the side air guide member is provided at a side of the main body, and air vents for blowing air outwardly are formed in the side air guide member.

In an embodiment of the present disclosure, the air vents in the side air guide member form an air dispersion structure.

In an embodiment of the present disclosure, the air dispersion structure includes at least one of micropores, bubbles, louvers and fan blades.

In an embodiment of the present disclosure, the side air guide member is a box having an inner cavity, and the side air guide member is provided with a side air inlet in communication with the air outlet.

In an embodiment of the present disclosure, the side air inlet is of an elongated shape arranged behind a terminus of the air outlet and extending along the terminus of the air outlet.

In an embodiment of the present disclosure, at most a portion of the side air inlet extends into the air outlet.

In an embodiment of the present disclosure, the air vents are provided in an outer side surface of the side air guide member.

In an embodiment of the present disclosure, the side air guide member is provided at each of the left side and the right side of the main body.

In an embodiment of the present disclosure, the side air guide member is formed as a side plate of the air conditioner.

In an embodiment of the present disclosure, an air guide board for opening and closing the air outlet is provided at a terminus of the air outlet, and the air guide board is provided with at least one of micropores, fan blades, louvers and bubbles.

Figure 1:
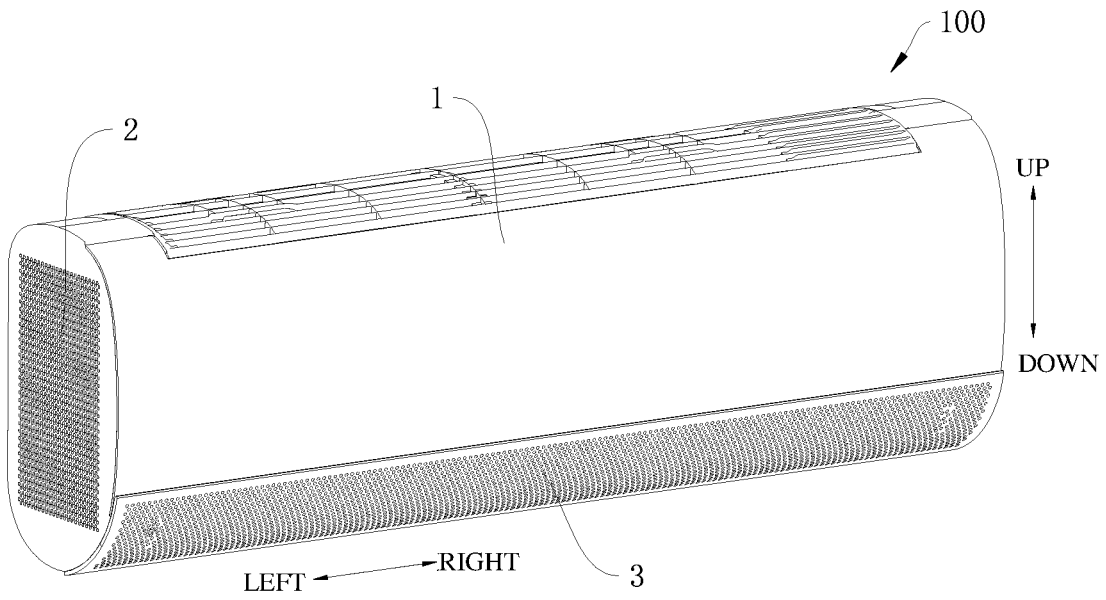
FIG. 1 is a schematic perspective view of an air conditioner according to an exemplary embodiment of the present disclosure.

REFERENCE NUMERALS air conditioner 100, main body 1, air outlet 101, side air guide member 2, air vent 201, side air inlet 202, air guide board 3.

DETAILED DESCRIPTION OF EMBODIMENTS

Embodiments of the present disclosure will be described in detail and examples of embodiments are illustrated in the drawings. The same or similar elements and the elements having same or similar functions are denoted by like reference numerals throughout the descriptions. Embodiments described herein with reference to drawings are explanatory, serve to explain the present disclosure, and are not construed to limit the present disclosure.

Figure 4:
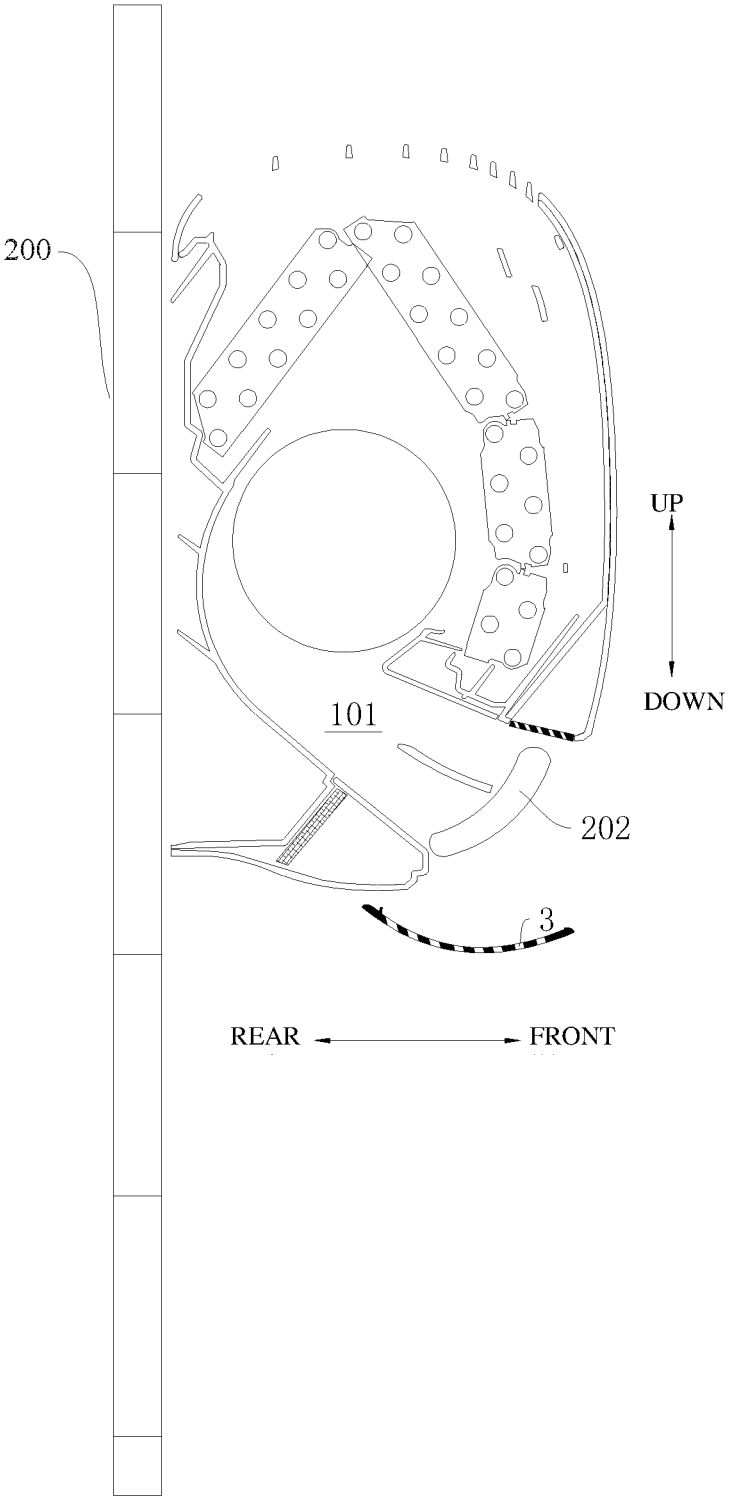
FIGS. 4 and 5 are schematic side views of an air conditioner according to an exemplary embodiment of the present disclosure, in which an air guide board is in an open state as shown in FIG. 4 and the air guide board is in a closed state as shown in FIG. 5.
Figure 5:
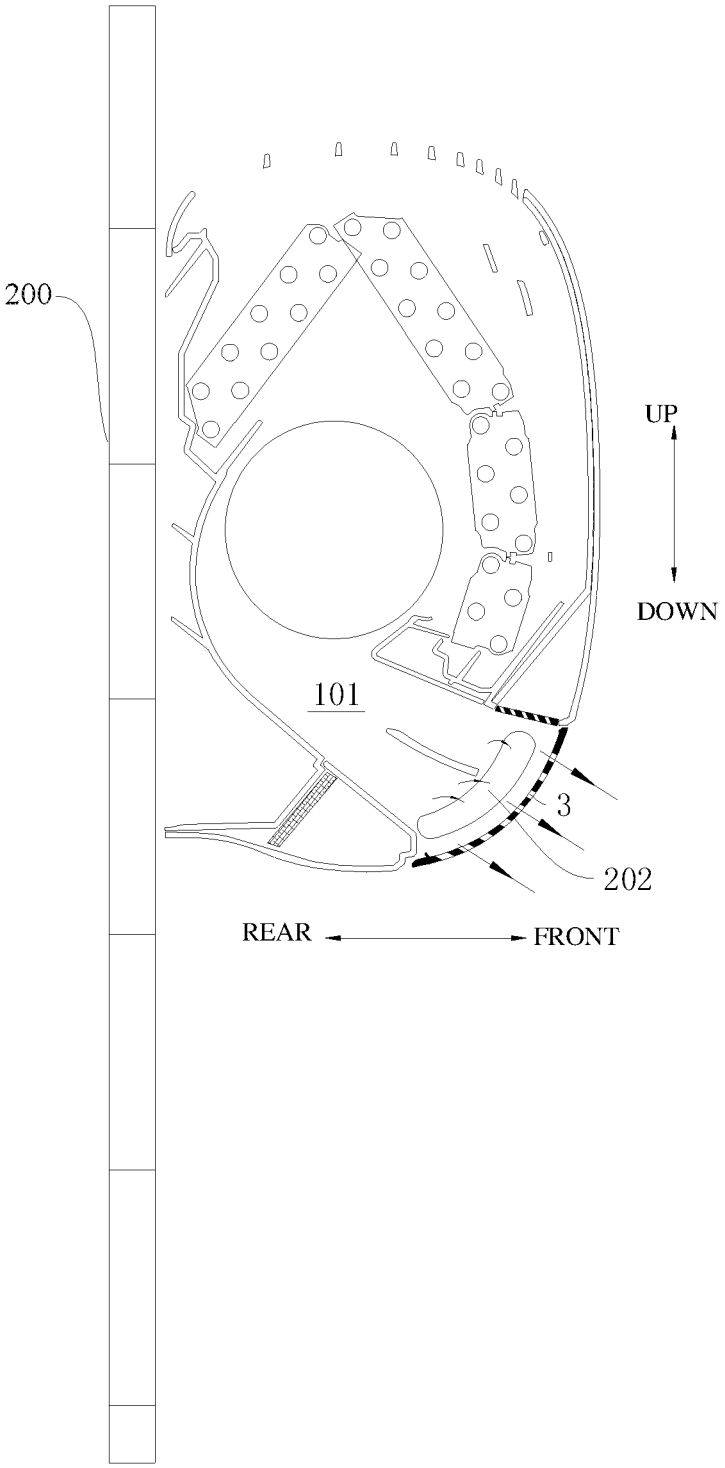

As shown in FIGS. 1, 4 and 5, an air conditioner 100 according to an exemplary embodiment of the present disclosure includes a main body 1. As shown in FIGS. 4 and 5, the main body 1 has a rear (or posterior) side, through which the air conditioner 100 is mounted to an outside support 200, which can be for example a wall of a household. The main body 1 also has a front (or anterior) side, which is distanced from the outside support 200 but opposite to the rear (or posterior) side of the main body. The main body 1 is provided with an air outlet 101 having a front (or anterior) opening, and in the shown embodiment, the front opening is provided at the lower front side of the air conditioner. In addition, the main body 1 is provided with at least one side air guide member 2, through which air can be blown to at least one of a left side and a right side of the air conditioner 100.

For the air conditioner 100 according to the embodiment of the present disclosure, the air conditioner 100 is provided with the side air guide member 2, and the side air guide 2 can discharge or divert a part of an airflow to be discharged through the air outlet 101, from a side of the air conditioner 100. Because the airflow discharged from the side of the air conditioner 100 is not directly blown to the front of the air conditioner 100, users will not feel the direct air-blowing from the front of the air conditioner 100, thereby achieving a windless effect.

In addition, since the air outlet 101 discharges air forwardly in the front and/or lower direction of the air conditioner 100, when a wind sensation is needed, the airflow can be controlled to be directly discharged through the air outlet 101, and in this case only little or no air is blown to the side of the air conditioner 100. Thus, the intensity of the airflow discharged through the air outlet 101 will not be diminished. That is, the air conditioner 100 of the present disclosure additionally provides a solution of blowing air laterally (along at least one lateral side of the air conditioner), while satisfying the need of blowing air forwardly in the front and/or lower direction of the air conditioner 100. As a result, the air blowing effect is further improved compared with known air conditioners.

In the present disclosure, the side air guide member 2 can be provided anywhere on the air conditioner 100 as long as at least part of the air discharged through the air outlet 101 of the air conditioner 100 can be returned, communicated or diverted to the two sides of the air conditioner 100. For example, the side air guide member 2 can be disposed at least partially inside the air outlet 101 to be in air communication with the air outlet 101, and configured to discharge air to the sides. In addition, the present disclosure provides some embodiments in which air is blown to the sides of the air conditioner 100.

As shown in FIG. 1, in some embodiments of the present disclosure, the side air guide member 2 is provided at at least one side of the main body 1, and the side air guide member 2 is formed with air vents 201 for blowing air outwardly from the air conditioner into the environment. The air guide provided at the side directly guides the airflow so as to directly control the lateral air discharge, thereby facilitating the side air blowing.

For example, the air vents 201 in the side air guide member 2 form an air dispersion structure. With the air dispersion structure, the airflow discharged from the side can be dispersed, so that the wind sensation is reduced, and an effect of "coolness but no wind sensation" can be achieved even at the side of the air conditioner 100.

For example, the air dispersion structure includes at least one of micropores, bubbles, louvers and fan blades.

Figure 2:
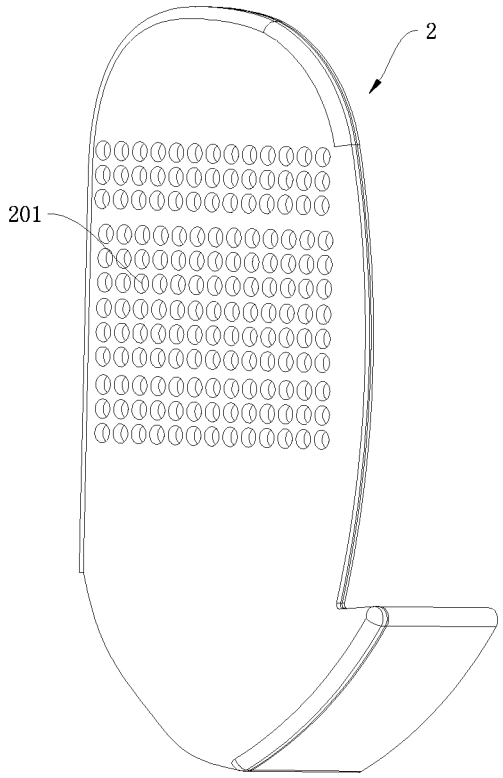
FIGS. 2 and 3 are schematic perspective views for illustrating a side air guide member of an air conditioner according to an exemplary embodiment of the present disclosure from different perspectives.
Figure 3:
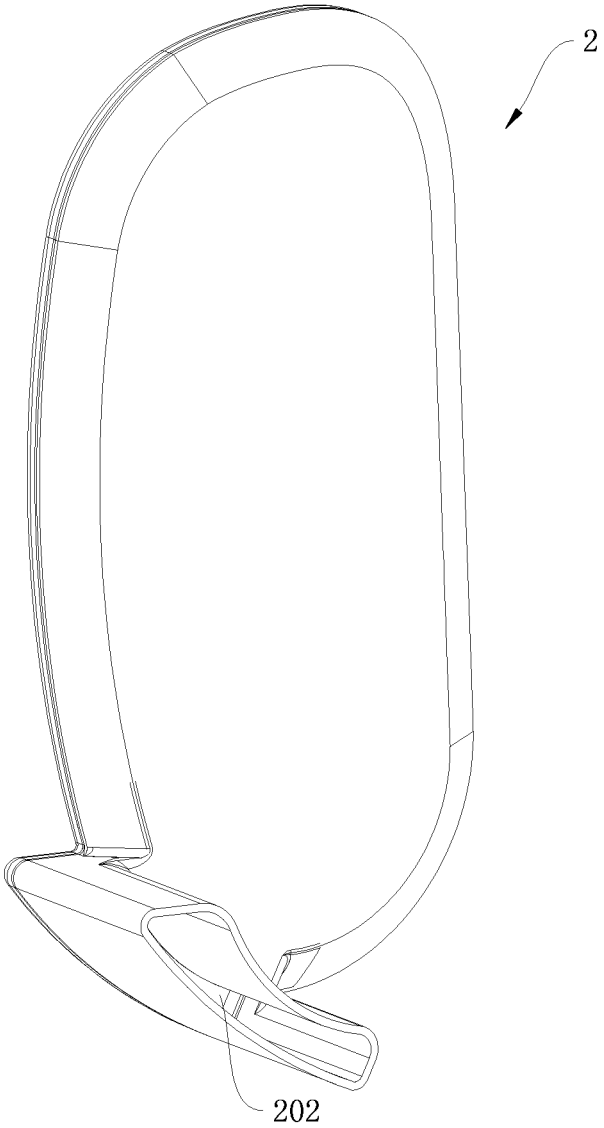

Referring to FIGS. 2 and 3, in an embodiment of the present disclosure, the side air guide member 2 can be in the form of a substantially enclosed structure, such as, a box having an inner cavity. The side air guide member 2 is provided with a side air inlet 202 in communication with the air outlet 101. The side air inlet 202 of the side air guide member 2 can guide the airflow at the air outlet 101 into the side air guide member 2, and the airflow is subsequently discharged from the side air guide member 2.

When the air outlet 101 is closed, if the air conditioner 100 is in a working state, the airflow enters the side air guide member 2 through the side air inlet 202 of the side air guide member 2, and is subsequently discharged at a preset position on the side air guide member 2, so that an effect of no wind sensation in the front is achieved. In addition, cold air (or warm air) entering the cavity will not easily flow back under the action of the cavity, so that more airflow can be discharged from the side air guide member 2, the cooling or warming efficiency of the air conditioner 100 is improved, and the energy efficiency is improved.

For example, as shown in FIGS. 4 and 5, the side air inlet 202 can be of an elongated shape and arranged in the proximity of a terminus of the air outlet 101 and extending along the terminus of the air outlet 101. The elongated side air inlet 202 allows more cold air (or warm air) to enter so as to further improve the lateral air blowing effect.

In addition, the side air inlet 202 is arranged adjacent to the terminus of the air outlet 101, and when the airflow flows to the terminus of the side air outlet 101, the airflow will be diverted under the action of an air guide board 3 or a door panel, so that more airflow can be blown to the side air guide member 2, and the air treatment efficiency is further improved.

For example, only a portion of the side air inlet 202 extends into the air outlet 101. The stability of connection between the side air inlet 202 and the main body 1 of the air conditioner 100 can be achieved, and more air can enter the side air guide member 2, so that the air guide effect at the side is improved.

Further, the air vents 201 are disposed in an external surface of the side air guide member 2.

In an exemplary embodiment of the present disclosure, the side air guide member 2 is provided at each of the left side and the right side of the main body 1. Within the scope of the disclosure, it is also possible to provide the side air guide member 2 only at one side of the main body 1. In general, the side air guide member 2 can be provided at the left side of the main body 1, or be provided at the right side of the main body 1, or be provided at each of the left and right sides of the main body 1.

In addition, the side air guide member 2 can be formed as a side plate of the air conditioner 100. Thus, the structure of the air conditioner 100 is simplified, and cooling (or warming) is facilitated.

As shown in FIGS. 4 and 5, in an embodiment of the present disclosure, the air guide board 3 for selectively opening and closing the air outlet 101 is provided at the terminus of the air outlet 101, and the air guide board 3 is provided with at least one of micropores, fan blades, louvers and bubbles. The switch between the wind sensation and no wind sensation can be performed by the air guide board 3, and the air guide member can guide the airflow.

In addition, other structures of the air conditioner 100, such as a fan wheel, will not be described in detail in the present disclosure, which should not be considered and/or interpreted as limiting the scope of the disclosure in any sense.

In the description of the present disclosure, reference throughout this specification to "an embodiment," "some embodiments," "an example," "a specific example," or "some examples," means that a particular feature, structure, material, or characteristic described in connection with the embodiment or example is included in at least one embodiment or example of the present disclosure. In the specification, the terms mentioned above are not necessarily referring to the same embodiment or example of the present disclosure. Furthermore, the particular features, structures, materials, or characteristics may be combined in any suitable manner in one or more embodiments or examples. Besides, any different embodiments and examples and features in different embodiments and examples may be combined by those skilled in the art without contradiction.

Although explanatory embodiments have been illustrated and described, it would be appreciated by those skilled in the art that the above embodiments are exemplary and cannot be construed to limit the present disclosure, and changes, modifications, alternatives and variations can be made in the embodiments by those skilled in the art without departing from the scope of the present disclosure.

What is claimed is:

1. An air conditioner comprising:

a main body comprising:

a front side;

a rear side, wherein the air conditioner is mountable to a support through the rear side of the main body, wherein the front side is distanced from the rear side and opposite to the rear side;

a front air outlet having a front opening on the front side of the main body that is configured to guide an airflow out of the front side of the main body; and a first side extending between the front side and the rear side;

a second side extending between the front side and the rear side and being on an opposite side of the main body from the first side; the front side, rear side, first side and second side together forming exterior surfaces of the air conditioner;

the first side comprises a side air guide member, the side air guide member comprising:

a side air inlet extending from the first side toward the second side, the side air inlet comprising a passage that opens toward the second side adjacent to the front opening of the front air outlet, the side air inlet being configured to guide at least a portion of the airflow from the front opening of the front air outlet to the first side of the air conditioner via the passage; and a side air outlet that is configured to guide the at least a portion of the airflow from the passage out of the first side of the air conditioner, wherein a portion of the side air inlet extends into the front opening of the front air outlet, such that the side air inlet partially overlaps the front opening of the front air outlet.

2. The air conditioner according to claim 1, wherein the side air outlet comprises air vents formed in the side air guide member that are configured to direct the at least a portion of the airflow outwardly from the first side of the air conditioner.

3. The air conditioner according to claim 2, wherein the air vents in the side air guide member form an air dispersion structure.

4. The air conditioner according to claim 3, wherein the air dispersion structure comprises at least one of micropores, bubbles, louvers and fan blades.

5. The air conditioner according to claim 1, wherein the side air guide member comprises an inner cavity, the passage of the side air inlet being continuous with the inner cavity.

6. The air conditioner according to claim 1, wherein the side air inlet has an elongated shape and is arranged in proximity to a terminus of the front opening of the front air outlet.

7. The air conditioner according to claim 1, wherein air vents are provided in an external surface of the first side.

8. The air conditioner according to claim 1, wherein the second side comprises a second side air guide member.

9. The air conditioner according to claim 1, wherein the side air guide member is formed as a side plate of the first side of the air conditioner.

10. The air conditioner according to claim 1, further comprising an air guide board that is configured to selectively open and close the front opening of the front air outlet, wherein when closed, the air guide board is configured to direct the airflow toward the passage of the side air inlet of the side air guide member.

11. The air conditioner according to claim 10, wherein the air guide board is disposed at a terminus of the front opening of the front air outlet.

12. The air conditioner according to claim 10, wherein the air guide board comprises at least one of micropores, fan blades, louvers and bubbles.

* * * * *